US010219322B2

(12) United States Patent
Schlipf

(10) Patent No.: US 10,219,322 B2
(45) Date of Patent: Feb. 26, 2019

(54) ELECTRIC HEATER WITH PLUG CONTACT

(71) Applicant: TÜRK & HILLINGER GMBH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 527 days.

(21) Appl. No.: 14/794,958

(22) Filed: Jul. 9, 2015

(65) Prior Publication Data

US 2016/0014844 A1 Jan. 14, 2016

(30) Foreign Application Priority Data

Jul. 10, 2014 (DE) ..... 10 2014 109 720

(51) Int. Cl.
*H05B 3/00* (2006.01)
*H05B 3/06* (2006.01)
(Continued)

(52) U.S. Cl.
CPC ..... *H05B 3/0014* (2013.01); *H01F 27/2823* (2013.01); *H01R 4/18* (2013.01); *H01R 24/38* (2013.01); *H01R 43/02* (2013.01); *H01R 43/048* (2013.01); *H01R 43/16* (2013.01); *H01R 43/24* (2013.01); *H05B 3/06* (2013.01); *H05B 3/08* (2013.01); *H05B 3/42* (2013.01); *H05B 3/48* (2013.01); *H05B 3/50* (2013.01); *H05B 3/52* (2013.01); *H01R 2103/00* (2013.01); *H05B 2203/012* (2013.01); *H05B 2203/014* (2013.01);
(Continued)

(58) Field of Classification Search
CPC ..... H05B 3/0014; H05B 3/026; H05B 3/06; H05B 3/08; H05B 3/42; H05B 3/48; H05B 3/50; H05B 3/52; H05B 3/44; H05B 2203/012; H05B 2203/014; H05B 2203/016; H05B 2203/017; H01F 27/2823; H01R 4/18; H01R 43/02; H01R 43/048; H01R 43/16; H01R 43/24; H01R 2103/00
See application file for complete search history.

(56) References Cited

U.S. PATENT DOCUMENTS 3,466,426 A * 9/1969 Kefauver, Jr. ..... F24C 15/104 219/459.1
3,492,624 A * 1/1970 Oakley ..... H05B 3/06 219/93
2013/0056456 A1* 3/2013 Schlipf ..... H05B 3/48 219/546

FOREIGN PATENT DOCUMENTS

CN 102984834 A 3/2013
CN 203136207 U 8/2013
DE 20 2011 105 348 U1 12/2011

* cited by examiner

*Primary Examiner* — Shawntina Fuqua
(74) *Attorney, Agent, or Firm* — McGlew and Tuttle, P.C.

(57) ABSTRACT

An electric heater (100, 200, 300, 400, 500, 600) includes a metal sheath (101, 201, 301, 401, 501, 601) defining an interior space, an electric heating element, arranged in the interior space, an insulating material filling and electric terminals. At least one electric terminal is a plug contact (108, 109, 208, 209, 308, 309, 408, 409, 508, 509, 608, 609) made in one piece, which has a section (108*b*, 109*b*, 208*b*, 209*b*, 308*b*, 309*b*, 508*b*, 509*b*, 608*a*, 609*b*) arranged in the interior space with a contact point (110, 111, 210, 211, 310, 311), which is arranged in the interior space and at which the plug contact is connected conductively to the electric heating element directly or via an auxiliary wire (212, 213, 312, 313, 612, 613). A process for manufacturing such an electric heater is provided.

20 Claims, 9 Drawing Sheets

(51) Int. Cl.

| | |
|---|---|
| ***H05B 3/08*** | (2006.01) |
| ***H05B 3/42*** | (2006.01) |
| ***H05B 3/48*** | (2006.01) |
| ***H05B 3/50*** | (2006.01) |
| ***H01F 27/28*** | (2006.01) |
| ***H01R 4/18*** | (2006.01) |
| ***H01R 24/38*** | (2011.01) |
| ***H01R 43/02*** | (2006.01) |
| ***H01R 43/048*** | (2006.01) |
| ***H01R 43/16*** | (2006.01) |
| ***H01R 43/24*** | (2006.01) |
| ***H05B 3/52*** | (2006.01) |
| *H01R 103/00* | (2006.01) |

(52) U.S. Cl.
CPC .. *H05B 2203/016* (2013.01); *H05B 2203/017* (2013.01)

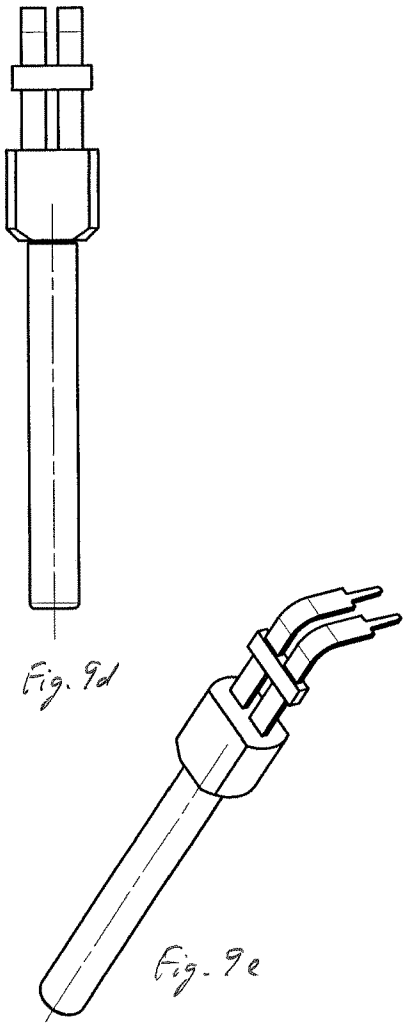
Fig. 9e
Fig. 9d
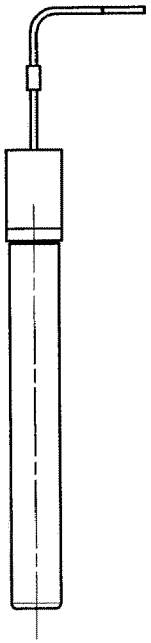
Fig. 9b
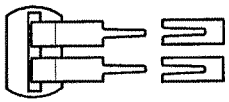
Fig. 9c
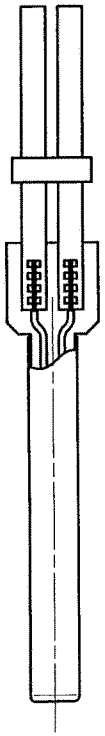
Fig. 9a
Fig. 9

ELECTRIC HEATER WITH PLUG CONTACT

CROSS REFERENCE TO RELATED APPLICATIONS

This application claims the benefit of priority under 35 U.S.C. § 119 of German Patent Application DE 10 2014 109 720.3 filed Jul. 10, 2014, the entire contents of which are incorporated herein by reference.

FIELD OF THE INVENTION

The present invention pertains to an electric heater having a metal sheath defining an interior space, at least one electric heating element, arranged in the interior space and electrically insulated by an insulating material filling and electric terminals for the at least one electric heating element and pertains to a process for manufacturing such a heater. Such electric heaters include, for example, heating cartridges, which are used, among other things, to heat many different components in the automobile industry, for example, for heating map-controlled thermostats.

BACKGROUND OF THE INVENTION

Prior-art heating cartridges have an often tubular metal sheath, which defines a tubular interior space. An electric heating element, which is usually designed as a heating wire winding on a coil support and is advantageously insulated electrically against the metal sheath by an insulating material filling, is arranged in this tubular interior space. To ensure the power supply for the electric heating element, connection wires, which are in electric contact with the heating wire winding, are led out of the metal sheath. A plug contact, e.g., a connection pin, a connection tongue or a connection jack are crimped or welded to these sections of the connection wires, which are led out of the metal sheath, such that there is a continuous electric contact between the plug contact and the electric heating element.

However, it is problematic in these electric heaters known from the state of the art that the contact points thus formed between the connection wire and the plug contact have proved to be prone to failure, especially in environments in which vibrations may occur, which happens in nearly all applications in connection with motor vehicles. Moreover, an additional manufacturing step, which is also prone to failure, namely, the crimping or welding of the connection wire and the plug contact, is associated with them.

SUMMARY OF THE INVENTION

Thus, an object is to provide a reliable electric heater with plug-in connector, which can be manufactured in a simple manner. This object is accomplished by an electric heater having the features according to the invention and by a process for manufacturing an electric heater having the features according to the invention.

The electric heater according to the present invention has a metal sheath defining an interior space, with at least one electric heating element, which is arranged in the interior space of the metal sheath and is electrically insulated against the metal sheath by an insulating material filling, and with electric terminals for the at least one electric heating element. For example, tubular metal sheaths define an interior space.

It is essential for the present invention that at least one electric terminal is a plug contact of a one-piece design, which has a section arranged in the interior space of the metal sheath with a contact point arranged in the interior space of the metal sheath, at which the plug contact is conductively connected to the electric heating element. The conductive connection may take place directly to the electric heating element or indirectly with the use of an auxiliary wire arranged between the heating element and the plug contact.

The present invention is based on the finding that by shifting the contact points into the interior space of the metal sheath, these critical points can be effectively protected from vibrations and other disturbing effects and that such a shift is made possible by the use of one-piece plug contacts, which have, on the one hand, a section that can be moved into the interior space of the metal sheath and, on the other hand, an integrally molded connection pin, an integrally molded connection tongue or an integrally molded connection jack. In particular, such plug contacts may be embodied as stamped contacts.

Even though each electric terminal designed in this manner reduces the risk of failure of the electric heater, all electric terminals are plug contacts made in one piece in an especially advantageous embodiment, which have each a section arranged in the interior space of the metal sheath with a contact point, which is arranged in the interior space of the metal sheath and at which the plug contact is connected conductively to the electric heating element.

Especially good protection is achieved against vibrations and other disturbing environmental effects if the contact point is embedded in the insulating material filling. Even better protective effect is obtained if the insulating material filling is compacted at least at the site at which the contact point is embedded in it.

In a preferred embodiment of the present invention, the electric heating element is a heating wire coil, which is wound on a coil body and whose ends are inserted into holes of the coil support. Further, one section each of the plug contact is likewise inserted into the hole of the coil body, and the conductive connection between the plug contact and the electric heating element at the contact point is established by pressing this section of the plug contact with the end of the heating wire coil, which end is inserted there. This embodiment make especially efficient production possible, because the coil-covered coil body can be used as a prefabricated assembly unit in it and the contact point can be produced simultaneously with the compaction of the insulating material filling and it does not require any additional working step.

However, the conductive connection between the plug contact and the electric heating element at the contact point may also be established, as an alternative, by welding or by crimping. The contact point may now be located directly in the area of the coil body, but sections of the coil body may also extend, starting from the coil body, in the direction of the terminals, which can then be welded or crimped at any desired point in the interior space of the metal sheath.

An advantageous variant of these variants provides for the conductive connection between the plug contact and the electric heating element to be established via an auxiliary wire, which is in electric contact with the plug contact at the contact point, by the electric heating element being a heating wire coil wound on a coil body, whose ends are inserted into holes of the coil body, by one section each of the auxiliary wire being likewise inserted into the hole of the coil body, and by the conductive connection between the auxiliary wire and the electric heating element being established by pressing this section of the auxiliary wire with the end of the heating wire coil, which end is inserted there. This has the advantage that crimping or welding, which takes place here between the plug contact and the auxiliary wire, can still be performed outside the metal sheath, which considerably simplifies this working step.

As an alternative, pressing of these two conductors may also be performed at this point instead of crimping or welding the plug contact and the auxiliary wire. This may be achieved especially with the use of small ceramic tubes with corresponding holes in them. A section each of the plug contact and auxiliary wire is inserted for this into a hole of the small ceramic tube, and the small ceramic tube is subsequently pressed. This preferably happens, when the small ceramic tube with the inserted sections of the plug contact and auxiliary wire is received in the interior space of the metal sheath, together with the compaction of the insulating material filling.

In particular, it can be made possible, when using this alternative, to carry out the filling of the interior space of the metal sheath with insulating material before the insertion of the plug contacts, without this leading to the need to push plug contacts through the insulating material filling when the small ceramic tube is arranged such that its terminal-side end face presets the maximum filling height of the insulating material filling, i.e., when this surface is at the same level as the surface of the insulating material after filling or protrudes over this surface.

To bring about the plug-type connection proper, it proved to be advantageous if at least one section of the plug contact, which is arranged outside the metal sheath, is provided with a plug housing extrusion-coated around this section. In particular, such a plug housing may also be arranged such that it is received directly at the terminal-side end of the metal sheath or is even received partially in the terminal-side end of the metal sheath, which can contribute to a further minimization of the effect of vibrations on the plug-type connection. If the plug housing is also extrusion-coated around a section of the metal sheath or if the plug housing has a section that is received in the interior of the metal sheath and is pressed there, increased tensile strength of the overall arrangement can be achieved at the same time.

A process according to the present invention for manufacturing such electric heaters comprises the steps of providing a metal sheath defining an interior space, an electric heating element and at least one plug contact made in one piece, which has a section, which can be arranged in the interior space of the metal sheath; of arranging the electric heating element in the interior space of the metal sheath; of establishing an electric contact at contact points between the plug contact and the electric heating element; of inserting the section of the plug contact into the interior space of the metal sheath; of filling the interior space of the metal sheath with an insulating material, which is preferably in the form of a powder or granular material; and of compacting this insulating material at least in some sections, at least in the area of the contact points. It is especially advantageous here if the electric heating element is designed as a coil body on which a heating wire is wound, and in which holes, preferably two holes, are arranged, into which the ends of the heating wire are inserted and received, wherein the holes are large enough to permit the insertion of a part of the section of the plug contact or of an auxiliary wire crimped or welded to this section, which respective section can be arranged in the metal sheath. The compaction after the insertion of these sections will then ensure the electric contact.

The plug contact may optionally be extrusion-coated before or after the compaction, so that a plug housing surrounding the plug contact or the plug contacts is formed. This leads to a manufacturing process for manufacturing an electric heater with a plug, which heater can be manufactured in an especially small number of steps rapidly and in a cost-effective manner.

It is also possible, in cases in which a plurality of plug contacts are provided, to provide these such that they are at first connected to one another and are separated only later, especially at the end of the process. This has the advantage that the insertion of a plurality of plug contacts is made possible in a single operation.

In another preferred embodiment of the process, the shaping of the contact sections of the plug contacts is carried out only after establishing an electric connection to the heating element. This may be carried out especially by stamping out the contacts. It is often necessary in practice to provide heaters with a standardized heat output, which heaters must be provided with adapted terminals each for use in a number of different devices. The need to manufacture a particular individual series for this can be avoided with the procedure thus described, and a standard assembly unit can be manufactured, instead, optionally also for stocking, which is then provided with the desired contacts and optionally with adapted extrusion-coated housings in a finishing step.

The present invention will be explained in more detail below on the basis of figures, which show exemplary embodiments of the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 9*a* is a view showing another heater that can be manufactured by means of the process according to the present invention;

FIG. 9*b* is another view showing the other heater that can be manufactured by means of the process according to the present invention;

FIG. 9*c* is another view showing the other heater that can be manufactured by means of the process according to the present invention;

FIG. 9*d* is another view showing the other heater that can be manufactured by means of the process according to the present invention; and FIG. 9*e* is another view showing the other heater that can be manufactured by means of the process according to the present invention.

DESCRIPTION OF THE PREFERRED EMBODIMENTS

Figure 1:
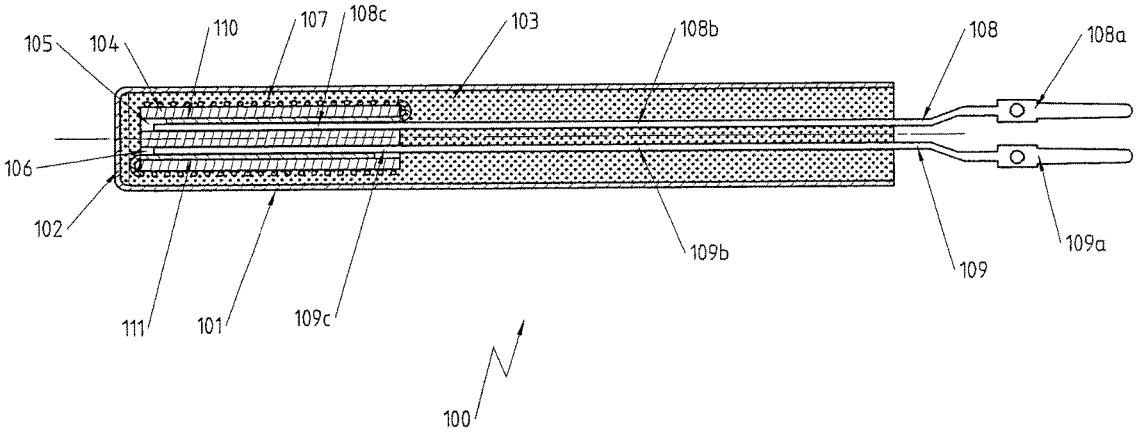
FIG. 1 is a cross sectional view through a first exemplary embodiment of the present invention.

Referring to the drawings, identical components of the same exemplary embodiments are designated below by identical reference numbers.

FIG. 1 shows an electric heater 100 with a tubular metal sheath 101, which is closed by an integrally molded bottom 102. A heating element, which comprises a coil body 104 with two holes 105, 106 passing through the coil body 104 in the direction in which the electric heater extends and a heating wire coil 107 wound on the coil body 104, is arranged in the interior space 103 defined by the metal sheath 101. One end of the heating wire coil 107 is inserted into the hole 105, and the other end into the hole 106.

Furthermore, two plug contacts 108, 109 are seen, which have, on the terminal side, an integrally molded contact tongue 108*a*, 109*a* each and a section 108*b*, 109*b* each arranged in the interior space 103 of the metal sheath 101. The end 108*c*, 109*c* of the plug contact 108, 109 located opposite the terminal side is inserted into a respective hole 105 and 106, respectively.

The dotted section in the area of the interior space 103 indicates that this area is filled with an insulating material filling consisting of a powder or granular material, which filling is compacted especially in the area of the metal sheath 101 in which the coil body 104 is located. The sections of the heating wire coil 107 and of the plug contacts 108*c*, 109*c*, which are received in the respective holes 105 and 106, are brought into conductive contact with one another by this compaction, so that contact points 110, 111, at which the heating wire coil 107 and sections 108*c*, 109*c* are conductively connected to one another, are formed.

Figure 2:
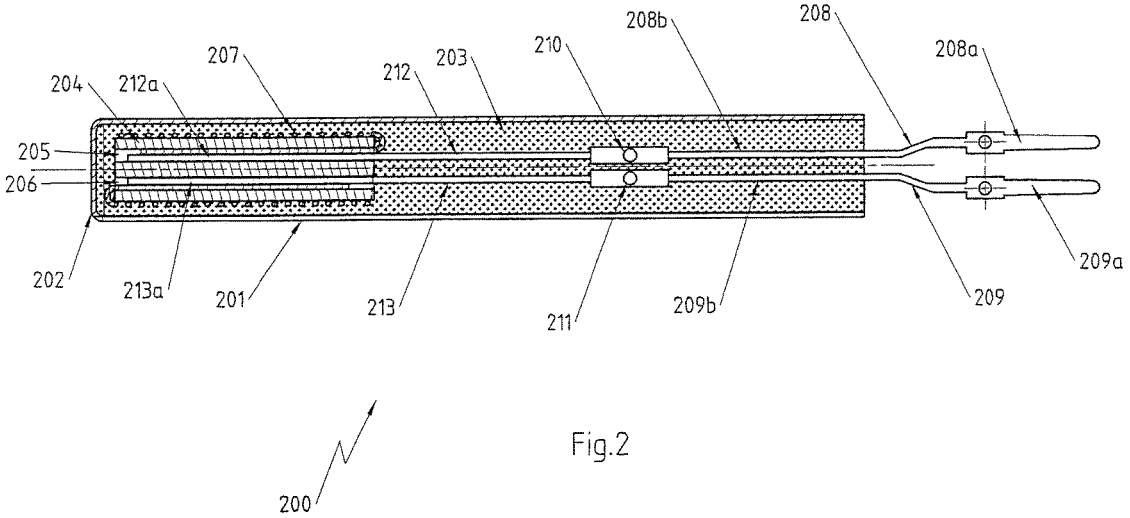
FIG. 2 is a cross sectional view through a second exemplary embodiment of the present invention.

The electric heater 200 according to FIG. 2 differs from the embodiment shown in FIG. 1 only in that the contact between the plug contacts 208, 209 and the heating wire coil 207 is brought about indirectly via auxiliary wires 212, 213, one section 212*a*, 213*a* of which is arranged in the holes 205, 206 of the coil body 204 instead of a section of the plug contacts 208, 209. The contact points 210, 211 are therefore formed by crimp sleeves, with which the sections 208*b*, 209*b* arranged in the interior space 203 of the metal sheath 201 are connected electrically conductively to the auxiliary wires 212, 213.

Figure 3:
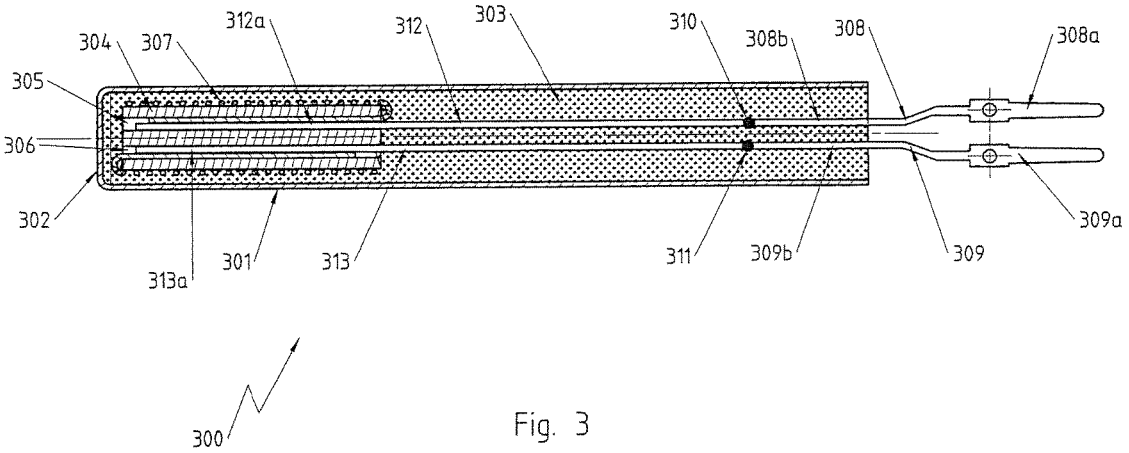
FIG. 3 is a cross sectional view through a third exemplary embodiment of the present invention.

The electric heater 300 according to FIG. 3 differs from the embodiment shown in FIG. 1 only in that the contact between the plug contacts 308, 309 and the heating wire coil 307 is established indirectly via auxiliary wires 312, 313, which are arranged in the holes 305, 306 of the coil body 304 instead of a section of the plug contacts 308, 309. The contact points 310, 311 are therefore formed by welds, with which the sections 308*b*, 309*b* arranged in the interior space 303 of the metal sheath 301 are connected to the auxiliary wires 312, 313 in an electrically conductive manner.

Figure 4:
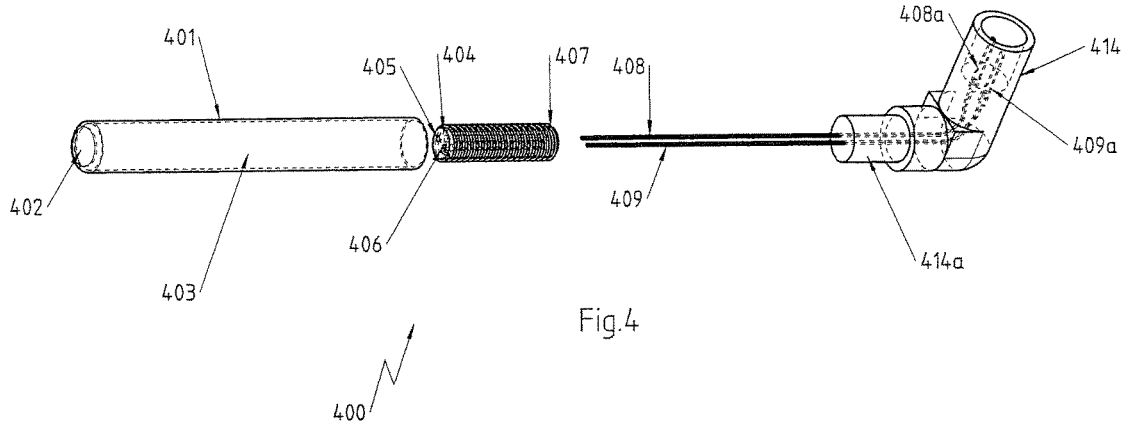
FIG. 4 is an exploded view of a fourth exemplary embodiment of the present invention.

The electric heater 400 shown in FIG. 4 as an exploded view has a design similar to that of the heater shown in FIG. 1 and differs from this in that the plug contacts 408, 409 have bent contact tongues 408*a*, 409*b*, which are extrusion-coated with a plug housing 414 in the form of an angle plug. The extrusion-coated areas of the plug contacts 408, 409 are not visible in reality and are therefore indicated by a dashed line in FIG. 4.

The plug housing 414 has a section 414*a*, which is dimensioned such that it can be inserted into the terminal-side end area of the metal sheath 401 with the bottom 402 and can be fixed there by pressing.

The exploded view in FIG. 4 shows once again clearly how simply the electric heater according to the present invention can be manufactured. The plug contacts 408, 409 can be manufactured in a simple stamping process, bent and extrusion-coated in a subsequent processing step with the plug housing 414, e.g., in the form of the angle plug, so that a prefabricated plug assembly unit is formed, from which the sections of the plug contacts 408, 409, with which sections the connection to the heating element is established, protrude. These sections have such a rigid design that they can carry their own weight without a noticeable deformation and can support the plug against a force applied along the direction in which they extend.

It is only necessary to insert the coil body 404 with the heating wire coil 407 arranged on it into the interior space 403 of the metal sheath 401. The insulating material filling, not shown in FIG. 4, in the form of a powder or granular material, can be poured into the metal sheath 401 in a first variant of the process before the plug assembly unit is inserted through the insulating material into the holes 405, 406 of the coil body 404.

However, a preferred alternative comprises the partial insertion of the sections of the plug contacts 408, 409, which shall be received in the holes 405, 406, into the holes 405, 406 before the filling before filling the metal sheath 401 (which may, in principle, also take place already when the coil body 404 is not yet inserted into the interior space 403 of the metal sheath 401, in which case the components thus preconfigured are inserted together into the metal sheath 401), after which the filling with the insulating material, not shown, is carried out, and the plug assembly unit is finally pushed a bit further into the interior space 403 of the metal sheath 401, so that the section 414*a* of the plug housing 414 is received at least partially in the metal sheath 401.

The electric contact between the plug contacts 408, 409 and the heating element 407 can then be established in a subsequent compaction step together or sequentially, the insulating material filling can be compacted, and the firm, non-positive and/or positive-locking seating of the plug housing 414, designed as an angle plug here, in the metal sheath 401 can be achieved.

As a result, a heater 400 comprising a small number of components with integrated plug is obtained, in which contact problems between individual components are extensively avoided.

Figure 5:
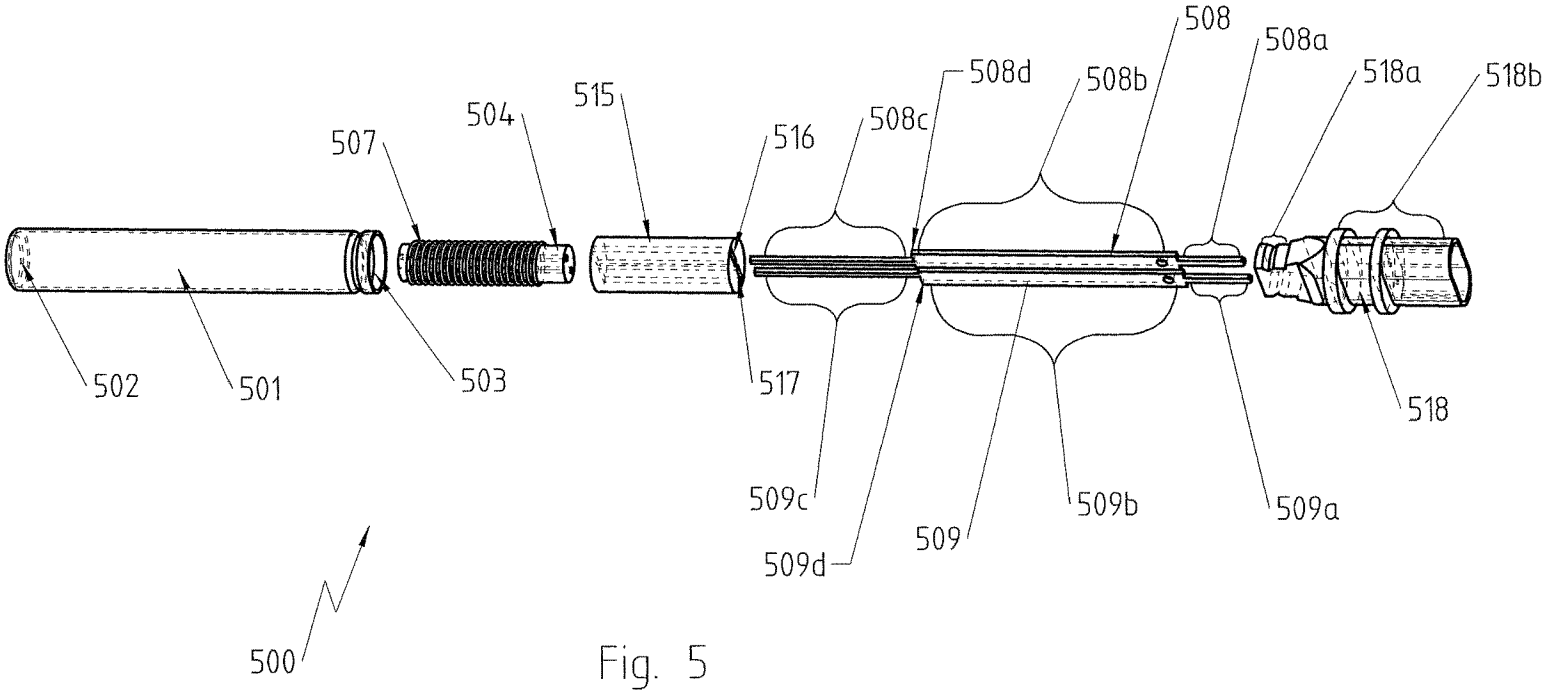
FIG. 5 is an exploded view of a fifth exemplary embodiment of the present invention.

The fifth embodiment of a heater 500, which is shown as an exploded view in FIG. 5, can be assembled in an especially simple manner. In addition to the coil body 504, on which a heating wire coil 507 is wound, an additional ceramic tube 515 with ducts 516, 517 contained therein for inserting the plug contacts 508, 509 is provided here.

The plug contacts 508, 509 have a heating coil contact section 508*c*, 509*c* each, which are inserted in the assembled state into holes 505, 506 in the coil body 504 and establish the contact with the heating wire coil 507 within the coil body 504. Furthermore, they have a guide section 508*b*, 509*b*, which is received in the ducts 516, 517 in the assembled state and is guided there. At the plug-side end, the plug contacts 508, 509 are provided with contact tongues 508*a*, 509*a* each. The guide section 508*b*, 509*b* is made broader or thickened compared to the heating coil contact section 508*c*, 509*c*, so that a stop 508*d*, 509*d* each is formed at the transition between the guide section 508*b*, 509*b* and the heating coil contact section 508*c*, 509*c*. If such a stop, which may also be formed in another manner and is also advantageous in itself without the additional features of the exemplary embodiments according to FIG. 5, is provided at the plug contact 508, 509, this has the advantage that the depth of insertion, i.e., the length of the section of the plug contact 508, 509, which is inserted into the coil body 504, is defined. As a result, good reproducibility of the length of the sections of the plug contacts 508, 509 protruding on the terminal side can be guaranteed by insertion up to the stop 508*d*, 509*d* even in case of manual manufacture.

Furthermore, a plug housing 518 is provided, which has a connection section 518*a* and a plug housing section 518*b* and is preferably extrusion-coated around the plug contacts 508, 509, so that at least parts of the contact tongues 508*a*, 509*a* are received in a cavity, which adjoins the terminal-side end face of the plug housing 518 and into which a counterplug can be inserted.

To assemble the heater 500, a metal sheath 501 is provided, which is provided with a bottom 502 and into which the coil body 504 on which the heating wire coil 507 is wound and the ceramic tube 515 are inserted. The length of the coil body 504 and of the ceramic tube 515 is preferably selected to be such that when these are brought into their end position in the metal sheath 501, they adjoin each other. Furthermore, the terminal-side boundary surface of the ceramic tube 515 preferably also presets in this position the desired filling height of the insulating material filling, which is subsequently filled in. It is guaranteed thereby that the plug contacts 508, 509, around which the plug housing 518 is extrusion-coated, can be inserted in the next step in a simple manner.

The metal sheath 501 advantageously protrudes on the terminal side over the ceramic tube 515 if a plug housing 518 is provided with a connection section 518*a*, whereas it may be advantageous in the embodiments without such a connection section 518*a* or entirely without a plug housing 518 but with an additional ceramic tube 515 if the metal sheath 501 and the ceramic tube 515 end in the same plane on the terminal side in the assembled state. Such a protrusion makes it possible to fix the plug housing 518 with the connection section 518*a* in the metal sheath 501 during the pressing of the insulating material filling, which is necessary anyway and which also ensures the electrical contact between the heating wire coil 507 and the plug contacts 508, 509.

Figure 6:
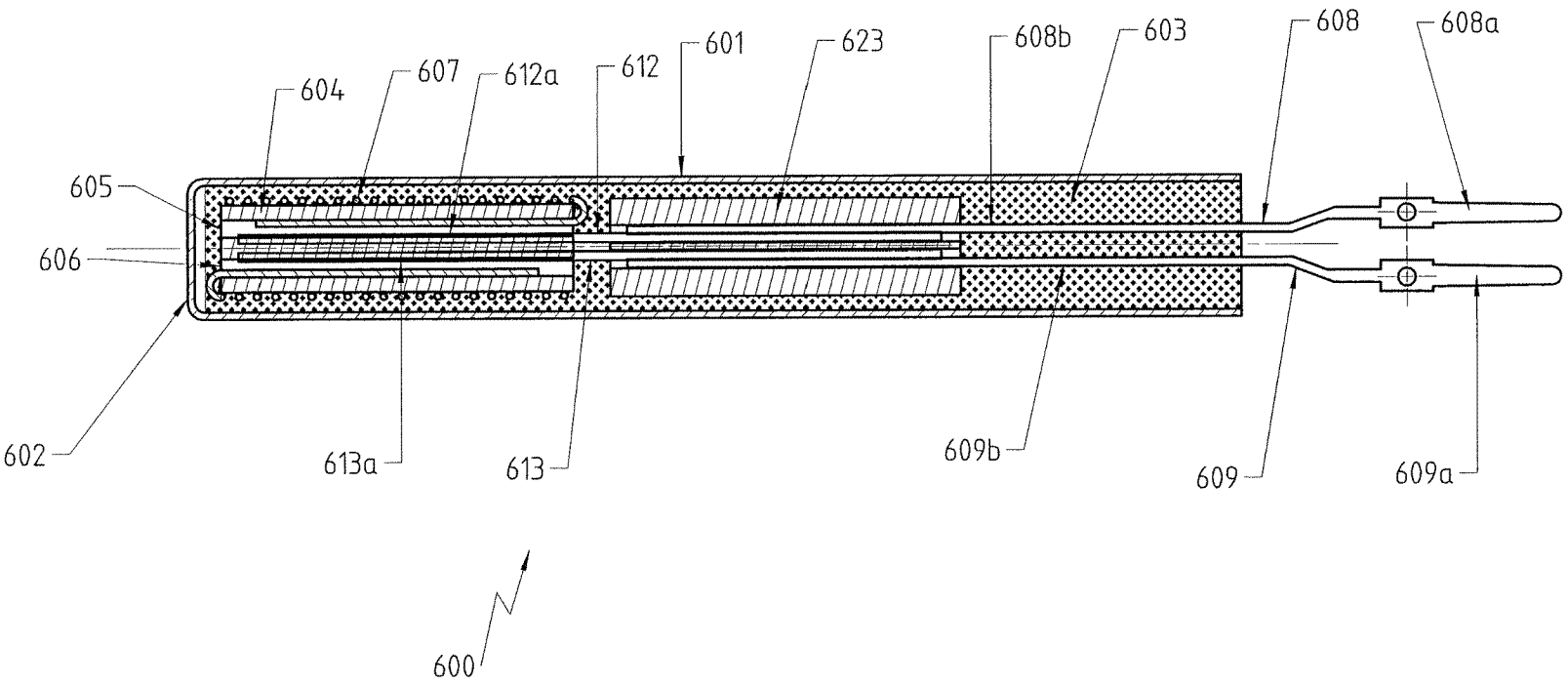
FIG. 6 is a cross sectional view through a sixth exemplary embodiment of the present invention.

FIG. 6 shows a cross section through a sixth exemplary embodiment of the present invention. The electric heater 600 according to FIG. 6 differs from the embodiment shown in FIG. 1 only in that the contact between the plug contacts 608, 609 and the heating wire coil 607 is established indirectly via auxiliary wires 612, 613, which are arranged in the holes 605, 606 of the coil body 604 instead of a section of the plug contacts 608, 609.

The contact between the plug contacts 608, 609 and the auxiliary wires 612, 613 is established here by inserting the ends of the plug contacts 608, 609, which ends face the coil body, and the terminal-side ends of the auxiliary wires 612, 613 into holes 621, 622 of a small ceramic tube 623 in such a way that they overlap each other and by bringing them then into contact with one another by pressing. Contacting by pressing is especially advantageous in case of low-voltage applications, because the effects of contact resistances can thus be reduced. In addition, welding of auxiliary wires 612, 613 and plug contacts 608, 609 may optionally be performed.

Figure 7:
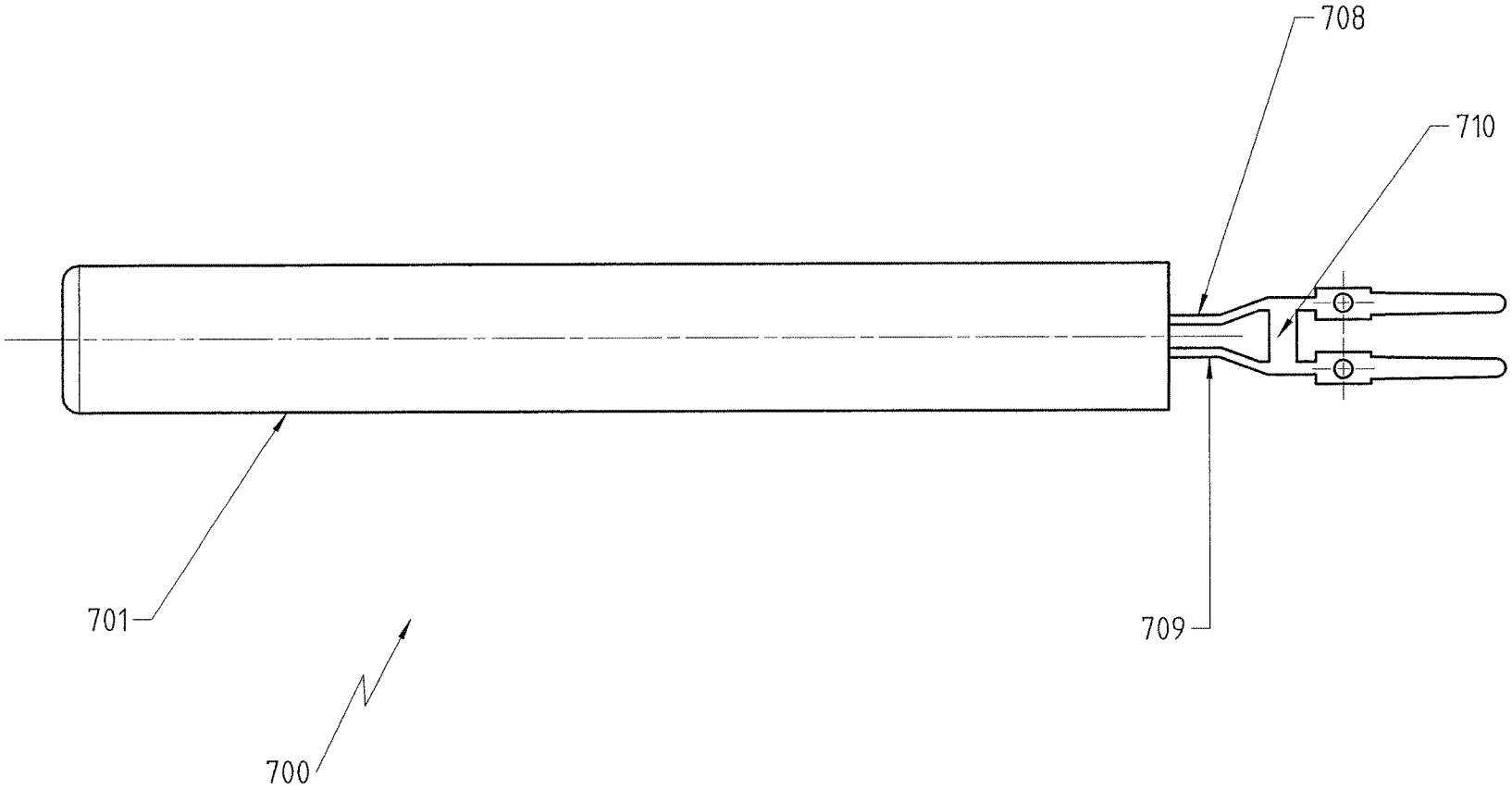
FIG. 7 is a schematic view of a possible intermediate stage in the manufacture of an electric heater according to the present invention.

FIG. 7 shows a schematic view of a possible intermediate stage in the manufacture of an electric heater, which may occur especially during the manufacture of the electric heaters according to FIGS. 1 through 3 and 6. The preliminary stage 700 of such an electric heater shown in FIG. 7 is obtained if the plug contacts 708, 709 are provided such that they are connected to one another via a connection piece 710, i.e., for example, they are stamped together. As a result, it becomes possible, on the one hand, to insert all plug contacts in one process step, and it is ensured, on the other hand, that the plug contacts 708, 709 are positioned accurately in relation to one another and especially that they protrude from the metal sheath 701 by exactly the same amount.

To obtain an operable electric heater, the plug contacts 708, 709 will then have to be separated from one another in a later process step, which may be carried out especially at the end of the manufacturing process, by removing the connection piece 710.

Figure 8A:
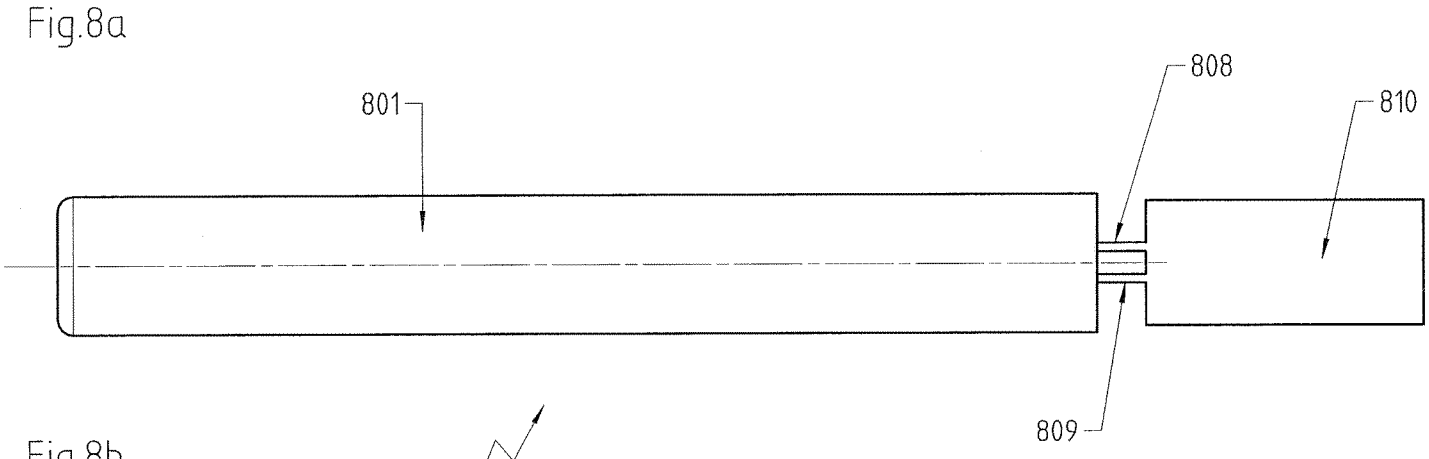
FIG. 8*a* is a schematic view of a possible intermediate stage in the manufacture of an electric heater according to the present invention, which is possible as an alternative to the intermediate stage according to FIG. 7.

Additional advantages arise if, instead of manufacturing the preliminary stage according to FIG. 7, a manufacturing process is selected, which likewise leads to the preliminary stage shown in FIG. 8, which may likewise occur especially in the embodiments of electric heaters shown in FIGS. 1 through 3 and 6. The preliminary stage 800 of such an electric heater with metal sheath 801, which preliminary stage is shown in FIG. 1, is obtained if the plug contacts 808, 809 are connected to one another via a connection piece 810, which represents the blank, from which the desired contact tongues are stamped later in the process.

Figure 8B:
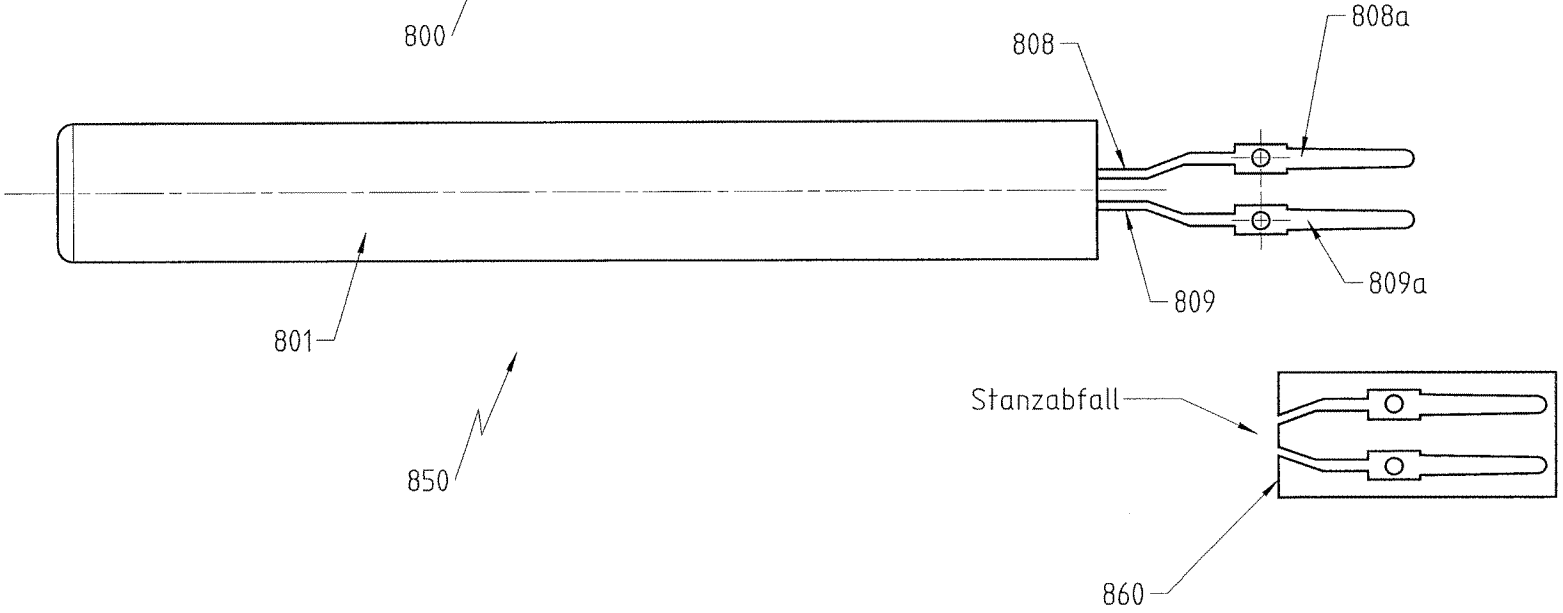
FIG. 8*b* is an electric heater from FIG. 8*a* after another process step.

The electric heater 850 manufactured according to this stamping step is shown in FIG. 8*b*. It differs from the preliminary stage 800 in that contact tongues 808*a*, 809*a* are stamped out of its connection piece 810, so that the plug contacts 808, 809 are no longer connected to one another. The stamping waste generated in this stamping step is shown as well.

As a result, it becomes possible, on the one hand, not only to insert all plug contacts in one process step, while, on the other hand, the plug contacts 808, 809 stamped later are positioned accurately in relation to one another and they especially protrude from the metal sheath 801 by exactly the same amount, but the corresponding assembly unit can be manufactured by mass production and can then be easily adapted to the requirements of different customers or use environments by a final second stamping step.

While specific embodiments of the invention have been shown and described in detail to illustrate the application of the principles of the invention, it will be understood that the invention may be embodied otherwise without departing from such principles.

APPENDIX

List of Reference Numbers

100, 200, 300, 400, 500, 600, 850 Electric heater
101, 201, 301, 401, 501, 601, 701, 801 Metal sheath
102, 202, 302, 402, 502, 602 Bottom
103, 203, 303, 403, 503, 603 Interior space
104, 204, 304, 404, 504, 604 Coil body
105, 106, 205, 206, 305, 306, 621, 622, 405, 406, 505, 506, 605, 606 Hole

107, 207, 307, 407, 507, 607 Heating wire coil
108, 109, 208, 209, 308, 309, 408, 409, 508, 509, 608, 609, 708, 709 Plug contact
108*a*, 109*a*, 208*a*, 209*a*, 308*a*, 309*a*, 408*a*, 409*a*, 508*a*, 509*a*, 608*a*, 609*a*, 708*a*, 709*a*, 808*a*, 809*a* Contact tongue of the plug contact
108*b*, 109*b*, 208*b*, 209*b*, 308*b*, 309*b*, 508*b*, 509*b* Section of the plug contact arranged in the interior space of the metal sheath
108*c*, 109*c*, 508*c*, 509*c* Section of the plug contact inserted into the coil body
110,111,210,211,310,311 Contact points
212, 213, 312, 313, 612, 613 Auxiliary wire
212*a*, 213*a*, 312*a*, 313*a* Section of the auxiliary wire inserted into the coil body
414 Plug housing
414*a* Section
508*d*, 509*d* Stop
516, 517 Ducts
518 Plug housing
518*a* Connection section
518*b* Plug housing section
623 Small ceramic tube
700, 800 Preliminary stage of an electric heater
710, 810 Connection piece
860 Stamping waste

What is claimed is:

1. An electric heater comprising:
a metal sheath defining an interior space;
at least one electric heating element arranged in the interior space of the metal sheath;
an insulating material electrically insulating the at least one electric heating element;
and
at least one electric terminal for the at least one electric heating element, wherein:
the at least one electric terminal comprise a one piece plug contact;
the at least one electric terminal has a section arranged in the interior space of the metal sheath;
the section has a contact point arranged in the interior space of the metal sheath;
the contact point comprises an electrical connection of the plug contact to the at least one electric heating element.

2. An electric heater in accordance with claim 1, further comprising another electric terminal comprising a one piece plug contacts, wherein:
the other electric terminal comprise another one piece plug contact;
the other electric terminal has another electric terminal section arranged in the interior space of the metal sheath;
the other electric terminal section has another electric terminal contact point arranged in the interior space of the metal sheath; and
the another electric terminal contact point comprises an electrically conductive connection of the plug contact to the at least one electric heating element, at which contact point the other plug is connected to the at least one electric heating element in an electrically conductive manner.

3. An electric heater in accordance with claim 2, wherein the contact point and the another electric terminal contact point are each embedded in the insulating material filling.

4. An electric heater in accordance with claim 3, wherein the insulating material filling is compacted at least at the point at which the contact point and the other electric terminal contact point is embedded into the insulating material filling.

5. An electric heater in accordance with claim 2, wherein:
the at least one electric heating element comprises a heating wire coil wound on a coil body, the heating coil having ends inserted into holes of the coil body;
a section each of the plug contact and the other plug contact is inserted into a respective hole of the coil body; and
the conductive connection between the plug contact and the at least one electric heating element and the other plug contact and the at least one heating element is established at the contact point by pressing the respective inserted section of the plug contact and the other plug contact with the respective end of the heating wire coil.

6. An electric heater in accordance with claim 1, wherein the conductive connection between the plug contact and the at least one electric heating element is established at the contact point by welding.

7. An electric heater in accordance with claim 1, wherein the conductive connection between the plug contact and the at least one electric heating element is established at the contact point by crimping.

8. An electric heater in accordance with one of the claim 1, wherein:
the conductive connection between the plug contact and the electric heating element is established via an auxiliary wire in conductive contact with the plug contact at the contact point;
the electric heating element comprises a heating wire coil wound on a coil body, the heating wire coil having ends inserted into holes of the coil body;
a section each of the auxiliary wire is inserted into one of the holes of the coil body; and
the conductive connection between the auxiliary wire and the electric heating element is established in the hole by pressing this inserted section of the auxiliary wire with the inserted end of the heating wire coil.

9. An electric heater in accordance with claim 1, further comprising a plug housing, wherein at least one section of the plug contact, which is arranged outside the metal sheath, is provided with the plug housing extrusion-coated around the at least one section.

10. An electric heater in accordance with claim 9, wherein the plug housing is also extrusion-coated around a section of the metal sheath.

11. An electric heater in accordance with claim 9, wherein the plug housing has a section, which is received in the interior of the metal sheath and is pressed at said section.

12. A process for manufacturing an electric heater, the process comprising the steps of:
providing a metal sheath defining an interior space;
providing an electric heating element;
providing at least one plug contact which is made in one piece and which has a section that can be arranged in the interior space of the metal sheath;
arranging the electric heating element in the interior space of the metal sheath;
establishing an electric contact at contact points between the plug contact and the electric heating element;
inserting a section of the plug contact into the interior space of the metal sheath; and
filling the interior space of the metal sheath with an insulating material.

13. A process in accordance with claim 12, wherein:

the electric heating element provided comprises a coil body and a heating wire wound thereon;

the coil body has two holes in which the ends of the heating wire are received;

the holes are large enough to permit the insertion of a part of the section of the plug contact or an auxiliary wire, which was crimped or welded to the section;

the section can be arranged in the metal sheath.

14. A process in accordance with claim 12, wherein:

the insulating material is in the form of a powder or granular material that is compacted insulating material at least in the area of the contact points;

an extrusion coating is performed before or after the compaction around the plug contact at least in a partial area comprising a contact tongue, of the plug contact, so that a plug housing surrounding the plug contact or plug contacts is formed at least in some sections.

15. A process in accordance with claim 12, further comprising another plug contact to provide a plurality of plug contacts such that the plug contacts are connected to one another and are only separated in a later process step.

16. A process in accordance with claim 15, wherein a shaping of the contact tongues of the plug contacts is performed only after the establishment of an electric connection of the plug contacts to the heating element.

17. A process in accordance with claim 12, further comprising shaping a contact tongue of the plug contacts after the step of establishing an electric connection of the plug contacts to the heating element.

18. A process in accordance with claim 12, wherein the metal sheath comprises a first end portion and a second end portion, the first end portion being located opposite the second end portion, the first end portion closing one end of the metal sheath, wherein the first end portion contains no openings, the at least one plug contact being located at the second end portion, the electric heating element being located adjacent to the first end portion, the at least one plug contact being formed from only one piece of material.

19. A process in accordance with claim 18, wherein the electric heating element comprises a hole, the at least one plug contact extending continuously, without interruption, from a position located outside of the metal sheath to a position located in the hole.

20. An electric heater in accordance with claim 1, wherein the metal sheath comprises a first end portion and a second end portion, the first end portion being located opposite the second end portion, the first end portion closing one end of the metal sheath, wherein the first end portion contains no openings, the at least one plug contact being located at the second end portion, the electric heating element being located adjacent to the one end of the metal sheath, the at least one electric heating element comprising a hole, the one piece plug contact extending continuously, without interruption, from a position located outside of the metal sheath to the electric heating element, wherein at least a portion of the one piece plug contact is located in the hole, the at least one plug contact comprising an outer surface extent extending from another end of the metal sheath continuously, without interruption, to a position adjacent to the electric heating element, wherein each portion of the outer surface extent is in direct contact with the insulating material, the another end being located opposite the one end of the metal sheath.

* * * * *